United States Patent [19]

Reynolds et al.

[11] Patent Number: 4,717,290

[45] Date of Patent: Jan. 5, 1988

[54] MILLING TOOL

[75] Inventors: Carl D. Reynolds, Oklahoma City; Thurman B. Carter, Jr., Tuttle; Shane P. Hart, Yukon, all of Okla.

[73] Assignee: Homco International, Inc., Bellaire, Tex.

[21] Appl. No.: 942,979

[22] Filed: Dec. 17, 1986

[51] Int. Cl.[4] ..... E21B 10/56

[52] U.S. Cl. ..... 407/34; 175/377; 299/89; 407/59

[58] Field of Search ..... 409/143, 203; 166/55, 166/55.2, 171, 376; 175/374, 377, 394, 406, 410; 299/55, 79, 87-91; 407/34, 58, 59, 61; 408/228

[56] References Cited

U.S. PATENT DOCUMENTS 2,328,494 8/1943 Reaney ..... 407/34
2,709,490 5/1955 Trimble et al. ..... 409/143 X
3,114,416 12/1963 Kammerer ..... 175/406 X
3,147,536 9/1964 Lamphere ..... 175/406 X

FOREIGN PATENT DOCUMENTS 2184963 7/1987 United Kingdom .

*Primary Examiner*—Gil Weidenfeld
*Assistant Examiner*—Steven C. Bishop
*Attorney, Agent, or Firm*—Michael J. McGreal

[57] ABSTRACT

This miling tool for underground work consists of a tool body which has a plurality of cutter blades. Each cutter blade has a negative axial rake and an essentially constant negative radial rake. In addition, each cutter arm has a close packing of cylindrical cutting grade tungsten carbide inserts set at a lead angle of about 0 to 10 degrees. The inserts are also preferably vertically offset on adjacent cutting blades.

32 Claims, 18 Drawing Figures

STRAIGHT

SPIRAL

STRAIGHT

SPIRAL

MILLING TOOL

This invention relates to a new milling tool which is used to remove various materials in an underground environment. In particular this invention relates to a milling tool for the removal of casing, collars, drill pipe, cement, jammed tools and other similar items. In use, the milling tool reduces the underground item to small pieces and shavings which are removed by a drilling fluid.

There is a special need in the oil and gas industry for tools which can remove the casing in an oil and gas well, drill collars, drill pipe and jammed tools. This is all accomplished from the surface with a tool on the end of a drill string. The drill string can range from hundreds to thousands of feet in length. Typically the working area in a well is about 3 to 10 thousand feet or more below the surface. In various operations at this subsurface point, a portion of the well casing may have to be removed so that drilling can be conducted in a different direction or a drill collar may have to be removed. One reason to remove casing is to permit the drilling of an additional well from the main well. Another use for the milling tools is to remove a tool jammed in the well. This latter use entails destroying the tool by milling through the tool in the hole. This then reopens the hole so that drilling may be commenced. There are yet other uses to which these milling tools can be put.

Milling tools have been used for many years in subsurface operations. Many of these tools have a lower pilot or guide section and an upper cutting section. These go under the names of pilot mills, drill pipe mills, drill collar mills and junk mills. There are yet other milling tools that are used in underground operations. These include starting mills, window mills, string mills, watermelon mills, tapered mills and section mills. Each of these mills is used for a different purpose. However, these mills all have one thing in common and that is to remove some material or item from a well hole. Also each of these mills accomplishes this in the same way by reducing the item to shavings and small chips.

Figure 7:
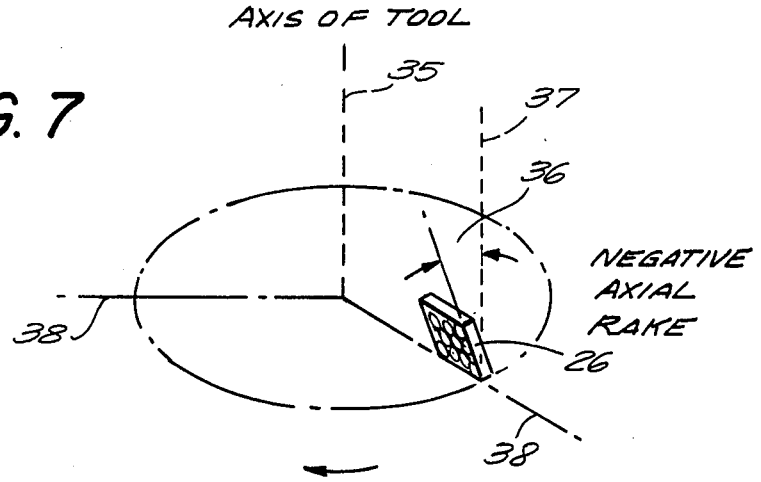
Figure 9:
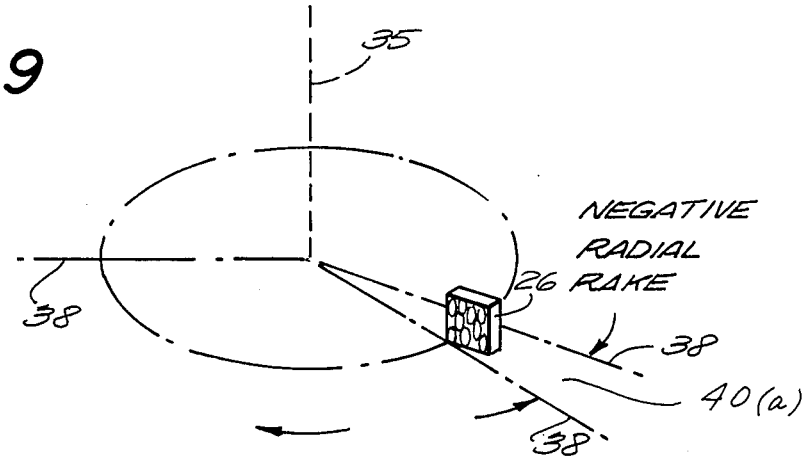

The various mills in use have different types of cutter blades. Some cutter blades are linear and longitudinally oriented on the tool body. In other tools, the cutter blades are at an angle to the longitudinal axis of the milling tool. And on yet other tools the cutter blades are in a spiral form on the tool body. The present invention sets out an improvement in each of these tools. This invention is directed to a milling tool where the cutter blades have a negative axial rake but an essentially constant negative radial rake. The axial rake is the degrees that a cutter blade is off the longitudinal axis of the tool. The radial rake is radial degrees that the cutter blade changes from the center axis of the tool from the lower point to the upper point on the cutter blade. FIGS. 7 and 9 which will be discussed later in this application provide a detailed explanation of axial rake and radial rake. A negative axial rake connotes that the cutter blade is slanted in the direction of tool rotation. A negative radial rake is the change in radial degrees in the direction of rotation of the tool. For this reason a cutter blade which is on the longitudinal axis of the tool body over its entire length will not have a negative axial rake or negative radial rake.

The axial rake of a cutter blade is set at a negative angle to give better cutting. This negative angle is usually about 2 to 10 degrees. If the cutter blade is linear the negative radial rake will then range from 0 degrees at the lower end of the cutter blade to 30 degrees or more at the upper end of the cutter blade. It varies throughout the cutter blade. It is only at a set negative axial rake and a set substantially constant negative radial rake that the tool will give optimum cutting throughout the entire length of the cutter blade. In general, the negative radial rake should be a substantially constant angle of between about 0 degrees to 30 degrees. This provides for optimum cutting under different conditions over the full length of the cutting blade. For a cutting blade where the negative radial rake exceeds 30 degrees or more there is poor milling.

It is also a part of this invention to use uniformly shaped tungsten carbide inserts on the leading surface of the cutter blades. Preferably the tungsten carbide inserts are in a cylindrical shape having a diameter of at least about 0.125 inch and a thickness of at least about 0.187 inch. These inserts are brazed onto the cutter blades in a tightly packed formation. Also, it is preferred that on adjacent cutter blades that the inserts be offset vertically at least about 0.0625 inch to 0.25 inch. The objective is to have a different part of an insert doing cutting on adjacent cutter blades. This is preferred since optimum cutting is in the first half of an insert. It is also preferred that the tungsten carbide inserts be placed on the cutter blade so that when mounted there will be a lead angle of about 0 to 10 degrees. Additionally, the tungsten carbide should be of a cutting grade rather than a wear grade material.

In brief summary this invention relates to new milling tools the cutter blades of which have a set negative axial rake and an essentially constant negative radial rake throughout their length. The cutter blades can be in a linear, spiral or other shape. In addition each of the cutter arms has brazed thereon cylindrical cutting grade tungsten carbide inserts. These inserts are preferably vertically offset in each adjacent cutter blade and further the cutting inserts should have a 0 to 10 degree lead angle when the cutter blade is attached to the tool body. In this way the cutter blade is in an optimum milling position throughout its entire length and the tungsten carbide inserts are in positions on the cutter blades so that at least some of the inserts are always in their optimum cutting mode.

Figure 1:
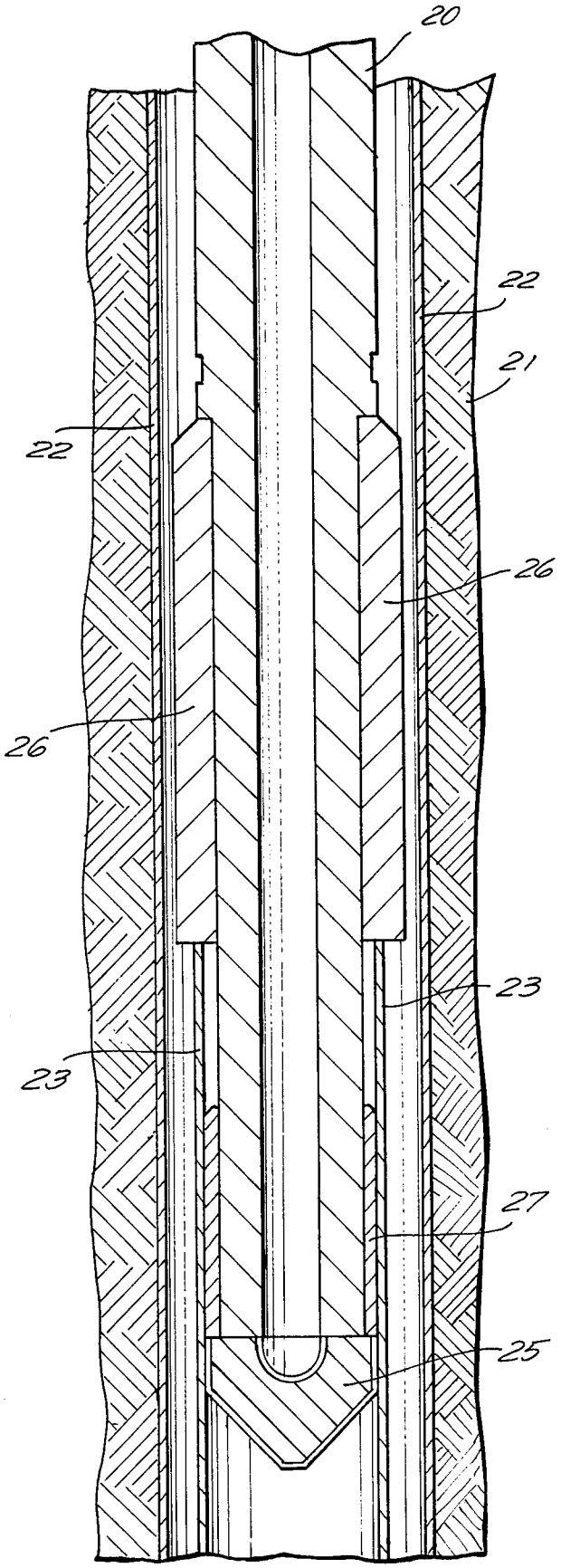

The milling tool will be discussed in more detail with reference to the following Figures:

FIG. 1—is a cross-sectional view of the milling tool cutting casing in an underground location.

Figure 2:
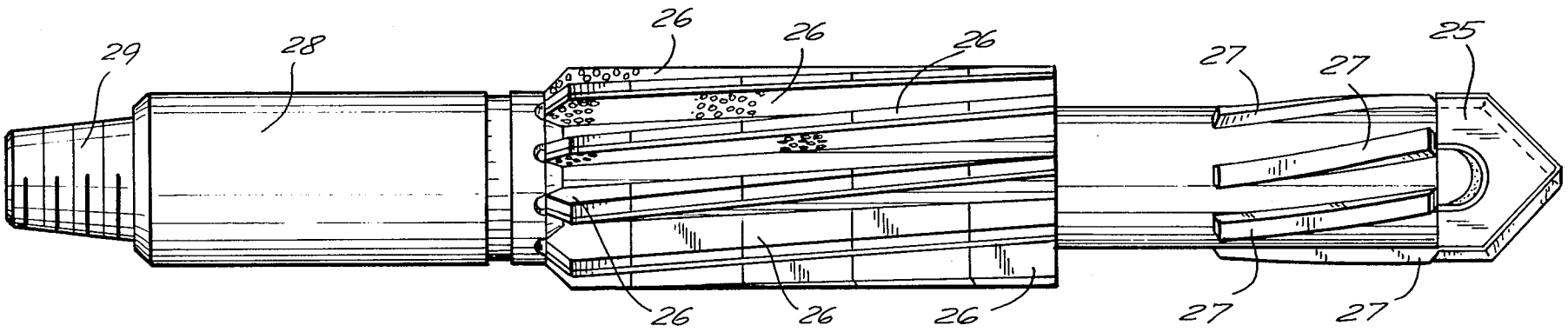

FIG. 2—is a perspective view of a milling tool having spiral cutter blades.

Figure 3:
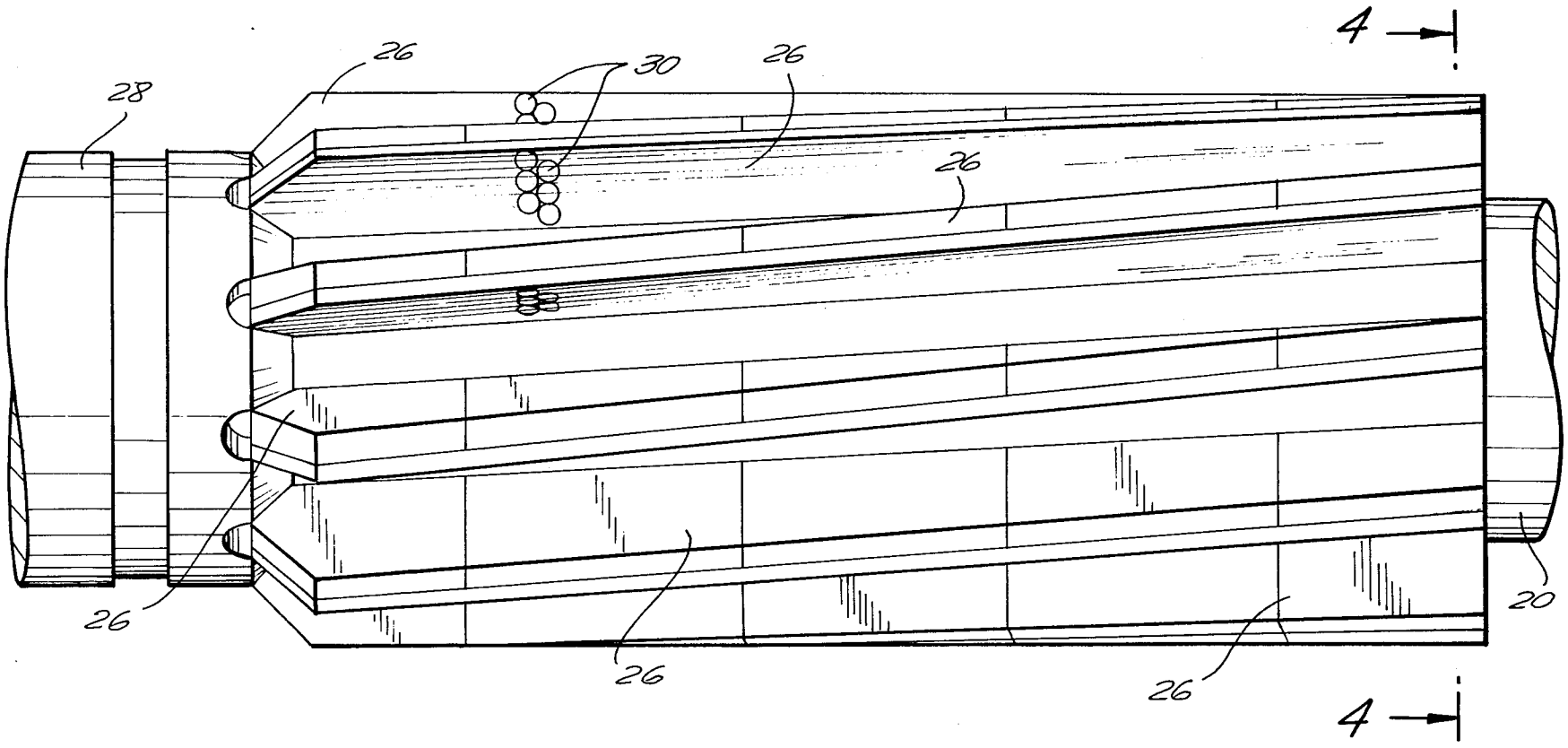

FIG. 3—is a perspective view of the cutter blade portion of milling tool of FIG. 2.

Figure 4:
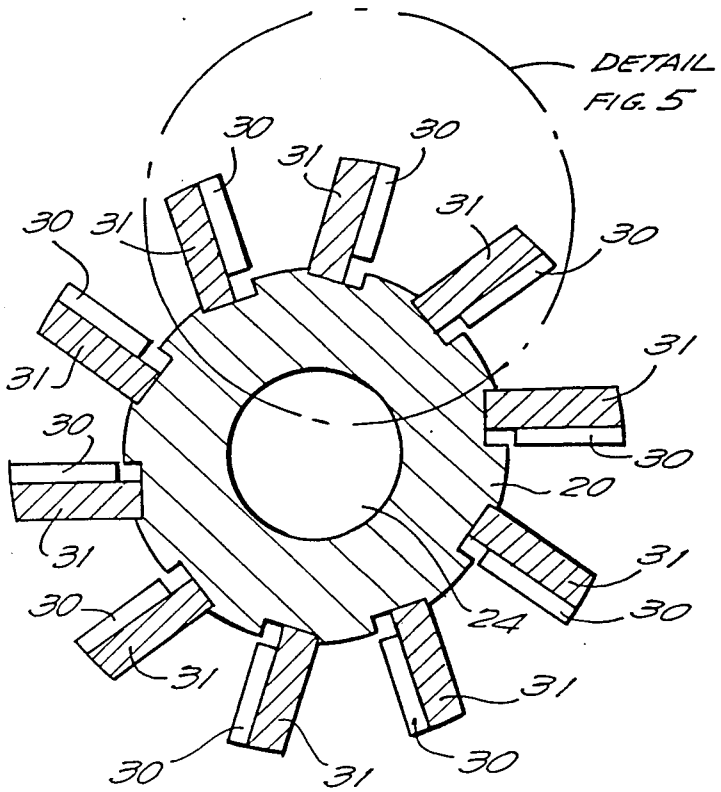

FIG. 4—is a cross-sectional view of the cutter blades of FIG. 3.

Figure 5:
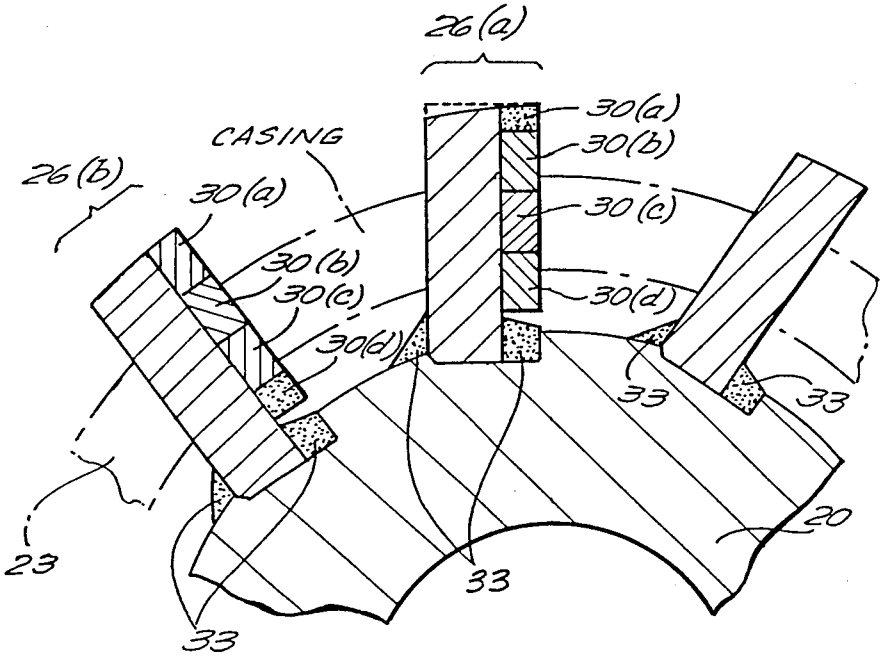

FIG. 5—is a detailed view of the cutter blades of FIG. 4.

Figure 6:
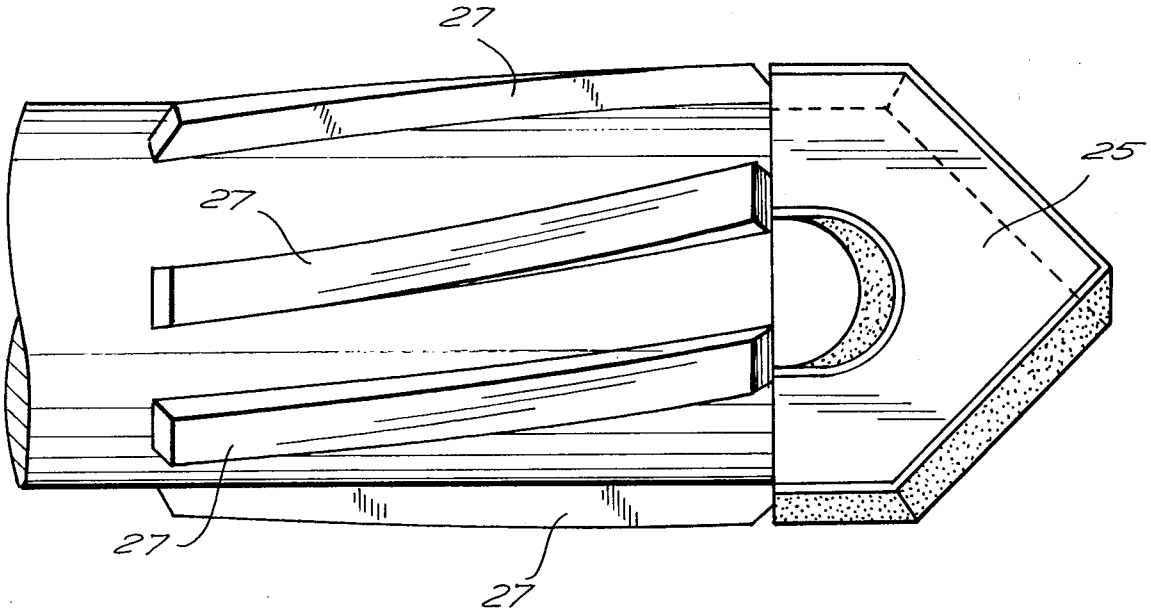

FIG. 6—is a perspective view of the pilot portion of a tool.

FIG. 7—is a schematic which describes negative axial rake.

Figure 8:
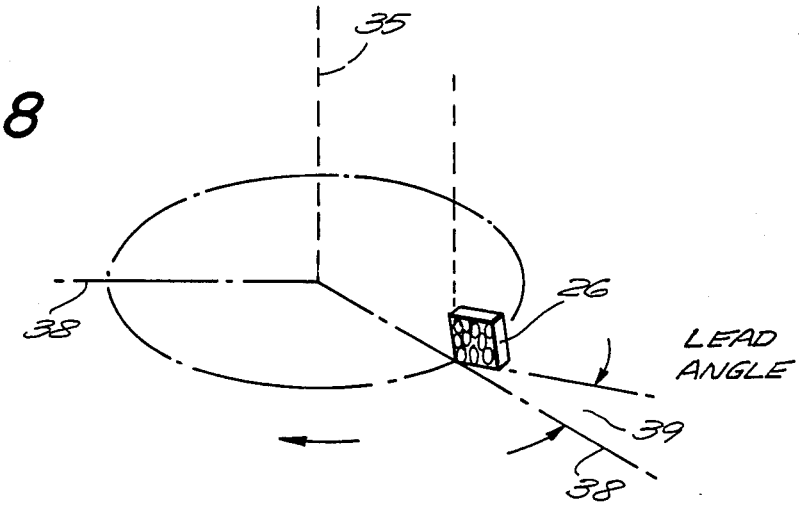

FIG. 8—is a schematic which describes lead angle.

FIG. 9—is a schematic which describes negative radial rake.

Figure 10:
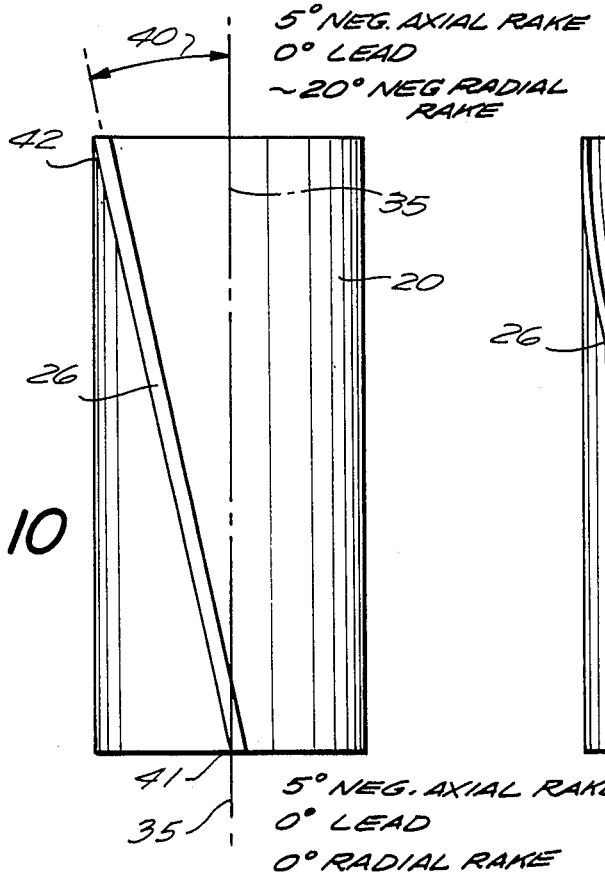

FIG. 10—is an elevational view showing the change in negative radial rake for a straight cutter blade having a 5 degree negative axial rake.

Figure 11:
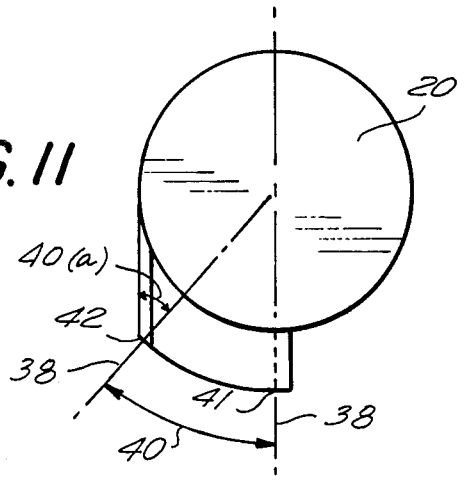

FIG. 11—is a schematic of the tool of FIG. 10.

Figure 12:
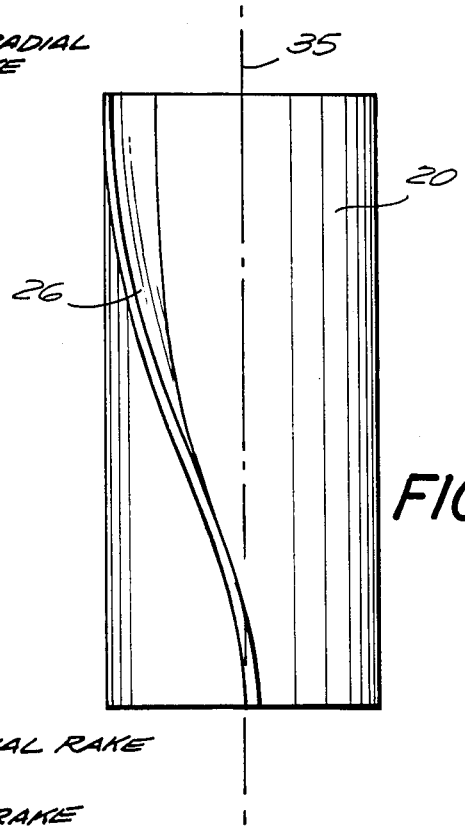

FIG. 12—is an elevational view showing the change in negative radial rake for a spiral cutter blade having a 5 degree negative axial rake.

Figure 13:
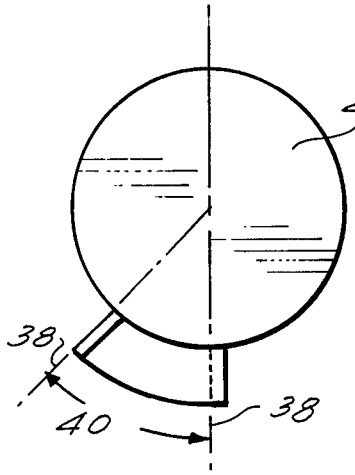

FIG. 13—is a schematic of the tool of FIG. 12.

Figure 14:
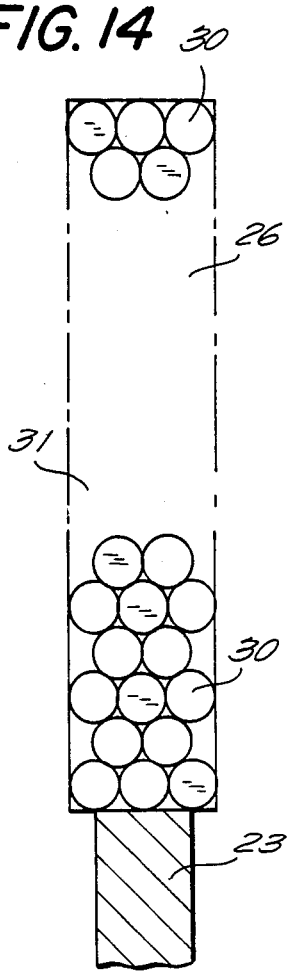

FIG. 14—is a front elevational view of a cutter blade cutting casing at a 0 degree lead angle.

Figure 15:
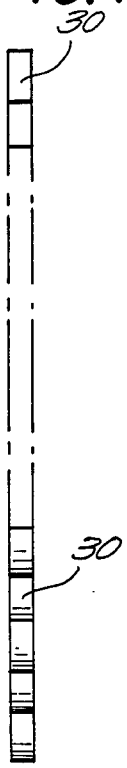

FIG. 15—is a side elevational view of the carbide inserts on a cutter blade.

Figure 16:
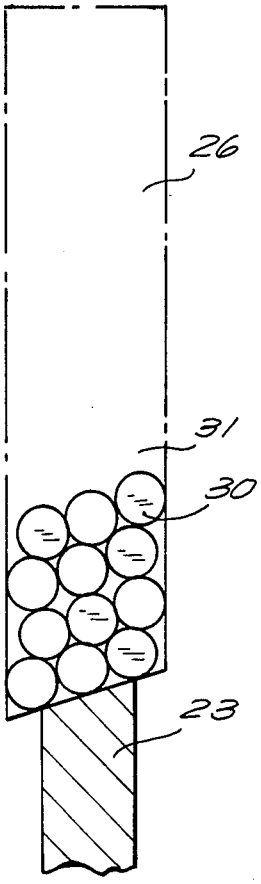

FIG. 16—is a front elevational view of a cutter blade cutting casing at a negative lead angle.

Figure 17:
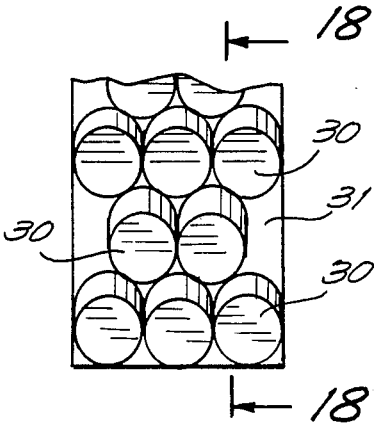

FIG. 17—is a sectional view of a linear cutter blade with inserts set at a given lead angle.

Figure 18:
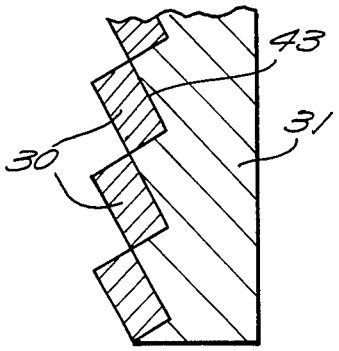

FIG. 18—is a sectional view of the cutter blade of FIG. 17.

The invention will now be discussed in more detail with specific reference to the drawings. FIG. 1 shows tool 20 removing an inner casing 23 from a gas and oil well. There is also shown an outer casing 22 surrounded by earth 21. As the tool rotates with a designated downward force on the tool the cutter arms 26 of the tool mill away casing 23 in a downward direction. The lower surface of each cutter blade cuts the casing with the blades wearing in an upward direction. The lower part of the tool 20 contains a pilot section 25. There are also guides 27 on the side of the lower part of the tool to stabilize the tool in the hole. In the center of the tool is channel 24 through which drilling fluid flows downward from the surface.

FIG. 2 shows an embodiment of the present tool with spiral cutting blades 26. The spiral is set at an angle where the negative axial rake is about 1 to 15 degrees and preferably about 3 to 10 degrees. The negative radial rake is constant the entire length of the cutter blade at a negative angle of 0 to 30 degrees. Preferably the negative radial rake is constant at about 5 to 15 degrees.

The upper portion of the tool consists of section 28 and threaded piece 29. Threaded piece 29 connects the tool to the drill string which extends down from the surface. Drilling fluid comes down from the surface to the tool through the drill string.

FIG. 3 shows the cutter blade section of the tool in more detail. Each of these cutter blades 26 has cutting inserts 30 on the leading surface of the blade. The leading surface is the surface of the tool in the direction of rotation of the tool. The cutting inserts are preferably a cutting grade of tungsten carbide. These inserts have a diameter of at least about 0.25 inch and preferably at least about 0.375 inch. The thickness of each insert is at least about 0.125 inch and preferably about 0.210 inch. They are packed in a pattern to maximize the number of inserts and to minimize voids. The inserts can be of the same or varying diameters. However, they should be of the same thickness. These inserts are brazed onto a piece of steel having a thickness of at least about 0.375 inch and preferably at least about 0.625 inch. This steel is a grade which will wear fairly readily when cutting casing. The intent is for the cutting to be done by the cutting inserts and not by the steel support for the inserts.

FIG. 4 provides a cross-sectional view of the tool showing in detail the cutter blades. In this view each cutter blade 26 consists of the steel support 31 which carries the inserts 30. A groove of slot 32 in the tool accepts each of the cutter blades. However, a grooved slot for each cutter blade is not necessary. The cutter blades can be welded directly onto the exterior surface of the tool.

FIG. 5 shows the connection of each cutter blade in more detail. This shows casing 23 being cut by the inserts on the blades 26 which are attached to the body 20 by weld material 33. These cutter blades are shown in grooved slots. This view also shows the inserts vertically offset on adjacent cutter blades. The cutter inserts are offset about 0.0625 to 0.25 inch. Inserts 30(*a*), 30(*b*), 30(*c*) and 30(*d*) on cutter blade 26(*a*) are offset from the similar inserts on cutter blade 26(*b*). FIG. 6 shows the lower pilot portion of the tool. The guides here are shown as in a spiral form. However, these can be straight guides on the longitudinal axis of the tool or set at a positive or negative axial rake. These guides can also have inserts of wear grade tungsten carbide on the outer surface. These are usually small disc which are attached flush to the blade by brazing.

FIG. 7 describes what is known as negative axial rake. The angle 36 is the negative axial rake. An axial rake is where the cutter blade is not axially oriented with the longitudinal axis of the tool. A negative axial rake is where the cutter blade is angled in the direction of the rotation of the tool. A positive axial rake is where the cutter blade is angled opposite the direction of the rotation of the tool. In FIG. 7 line 35 designates the center longitudinal axis of the tool. Line 37 is a line at the periphery of the cutter blade of the tool and parallel to center axis 35. Line 38 designates the horizontal axis of the tool. The angle 36 is the angle between the cutter blade 26 and the center axis 35 of the tool 20 shown here as the angle between the cutter blade extended and line 37. This is a negative axial rake since the cutter blade is angled in the direction of tool rotation as designated by the arrow. A negative axial rake provides for a better cutting of the metal or other material.

FIG. 8 describes what is meant by lead angle. The lead angle 39 is the angle which cutter blade 26 is offset from the horizontal axis 38. A cutter blade where the cutter blade lower surface is on the horizontal axis 38 throughout this lower surface would have a 0 degree lead angle. The lead angle of a cutter blade cutting casing is shown in more detail in FIG. 16. In essence, as the lead angle of a cutter blade increases, the casing is cut at a sharper angle.

FIG. 9 describes what is meant by negative radial rake. A radial rake is the change in the radial angle of the cutting surface from the longitudinal axis of the tool from the bottom of a cutter blade to the top of a cutter blade. A straight cutter blade which has a 0 degrees axial rake would have a constant radial rake. A displacement of the radial angle in the direction of rotation of the tool is a negative radial rake while a displacement in the opposite direction is a positive radial rake. When a straight cutter blade is attached to a tool with a negative axial rake, it will have a negative radial rake. And likewise if a cutter blade is attached to the tool with a positive axial rake, it will have a positive radial rake. The degree of the radial rake will depend on the diameter of the tool and the length of the cutter blade. As the cutter blade length increases the radial rake for a specific axial rake will increase. FIG. 9 shows the negative radial rake angle 40(*a*) for a straight blade having a negative axial rake. It is necessary for good cutting for a cutter blade to have a constant radial rake for a set negative axial rake. A spiral cutter blade, or a straight cutter blade as in FIGS. 17 and 18 with angled cutting inserts, will give a substantially constant radial rake for a given negative axial rake.

FIGS. 10 and 11 further illustrate the change in negative radial rake 40(*a*) for a straight cutter blade having a negative axial rake of 5 degrees. For simplicity the cutter blade will have a 0 degree lead angle. The displacement angle of the cutter blade is designated as 40. The negative radial rake angle will vary with the tool body outer diameter. For example, an eight inch outer diameter tool with a 12 inch blade length varies from a 0 degree negative radial rake at 41 to the maximum radial rake of more than 20 degrees at 42, the upper end of the cutter blade. In contrast, FIGS. 12 and 13 show the use of a spiral blade. This spiral blade has a 5 degree negative axial rake. Again for simplicity there is a 0 degree lead angle. The negative radial rake is in this instance a constant 0 degrees. In order to have maximum cutting over the full length of the cutter blade, there should be a constant negative radial rake. Otherwise, the tool has a high efficiency at only one area of the cutter blade.

In FIGS. 10 and 11 the radial rake angle 40(*a*) will be the same as the displacement angle 40. This is the case since the radial rake is 0 at the lower end of the cutting blade. However, if the radial rake is not 0 at the lower end of the cutting blade the radial rake and the displacement angle will not coincide. FIG. 11 illustrates the radial rake as being the angle that the end of the cutter blade is off of a radial axis 38 of the tool. That is the cutting portion of the blade is not axial throughout its length. It constantly changes. In contrast in FIG. 13 the displacement angle 40 is the same as for the straight blade, but the blade spirals so that the cutting portion of the blade is axial throughout its length.

FIG. 14 shows a cutter blade 26 with inserts 30 with a 0 degree lead angle. This is shown cutting casing 23. The inserts are close packed and need not be of the same diameter. They should, however, be of the same thickness. Although a wear grade of tungsten carbide can be used, it is preferred that they be of a cutting grade. FIG. 15 is an elevational view of the carbide inserts. FIG. 16 shows a cutter blade with inserts having a lead angle of about 5 to 10 degrees. The cutting blades in these figures are preferably spiral cutting blades, although they could be in a straight blade form. Also, in FIG. 16 the metal support 31 can be rectangular but with the inserts set at the lead angle. In the use of such a tool, the metal would quickly wear up to the inserts. Also, the metal below the inserts could be covered with a crushed tungsten carbide which would initiate the cutting of the casing.

FIGS. 17 and 18 disclose the embodiment of a straight cutter blade which would have a negative axial rake, but yet a constant negative radial rake. Here the cutting inserts are set at the desired negative axial rake. This is accomplished by the cutter arms having stepped angled grooves 43 to accept the inserts. The angle of the stepped groove determines the angle of the negative axial rake. This cutter blade with the inserts set at a predetermined negative axial rake can be attached on the tool so that it has a 0 to 30 degrees negative radial rake. In addition, this blade can be made to any desired lead angle.

As a further alternative the grooved slot can vary in depth so that a row of cutting inserts will be at varying heights. Also each grooved slot can be of a different depth. Using these alternatives, the radial rake of the cutter blades can be varied.

The main objective of this invention is to have a milling tool where the cutter blades are at an optimum cutting orientation throughout the length of the cutter blades. This is important when it is a costly operation to change tools. When cutting blades are not at the optimum cutting orientation the tool will remove less and less material as the cutter blades wear and will usually generate more heat due to the rubbing contact with the casing or other item being cut. At a certain point the heat level will reach a point to cause the tool to fail. These new milling tools have an increased life when milling oil field and other casing since they maximize cutting and minimize heat generation. This translates into being able to remove 4 to 10 times more casing before a milling tool has to be removed and replaced. Considering that in oil field use it can take 8 hours or more to remove a milling tool from a drill hole, replace the tool and then get the new milling tool back down into the drill hole, being able to remove 4 to 10 times more casing per tool produces considerable savings.

The present disclosure has been directed to set cutter blades. That is, the cutter blades are welded to the tool. However, this discovery is fully applicable to extendable cutter blades such as in section mills. The objective is to use cutter blades set at a negative axial rake and a constant radial rake and usually a constant negative radial rake. The method of attachment of the cutter blades to the tool is not a critical feature. For extendable cutter blades the blades can be mechanically or hydraulically extended. In addition, the cutter blade can pivot at one point and extend outward or the blade extend outward the same amount throughout its length. Section mills are tools which have extendable cutter blades. Standard section mills can be adapted to use the features which have been described herein. Various other modifications can be made to milling tools and yet be within the present discovery.

I claim:

1. A milling tool to remove material from an underground location comprising a cylindrical tool body, a longitudinal passage through said tool body, means at one end for connection to a drive means, and a plurality of cutter blades having cutting inserts thereon attached to the surface of said tool body, said cutter blades having a negative axial rake of about 1 to about 10 degrees and a substantially constant negative radial rake.

2. A milling tool to remove material from an underground location as in claim 1 wherein the cutting blades are in a spiral form on said cylindrical tool body.

3. A milling tool to remove material from an underground location as in claim 2 wherein the cutting inserts on said cutter blades have a lead angle of about 0 to about 10 degrees.

4. A cutting tool to remove material from an underground location as in claim 2 wherein the substantially constant negative radial rake is an angle of about 0 to about 30 degrees.

5. A milling tool to remove material from an underground location as in claim 2 wherein the leading surface of each cutter blade has thereon a plurality of cylindrical cutting inserts.

6. A milling tool to remove material from an underground location as in claim 5 wherein said cylindrical cutting inserts have a thickness of at least about 0.125 inches and a diameter of at least about 0.25 inches.

7. A milling tool to remove material from an underground location as in claim 6 wherein said cylindrical cutting inserts have a thickness of about 0.210 inches and a diameter of about 0.375 inches.

8. A milling tool to remove material from an underground location as in claim 7 wherein the cylindrical inserts are cutting grade tungsten carbide inserts.

9. A milling tool to remove material from an underground location as in claim 1 wherein the leading surface of each cutting blade has a plurality of cylindrical cutting inserts.

10. A milling tool to remove material from an underground location as in claim 9 wherein said cylindrical cutting inserts have a thickness of at least about 0.125 and a diameter of at least about 0.25 inches.

11. A milling tool to remove material from an underground location as in claim 10 wherein said cylindrical cutting inserts have a thickness of about 0.210 inches and a diameter of about 0.375 inches.

12. A milling tool to remove material from an underground location as in claim 1 wherein the cutting inserts on said cutter blades have a lead angle of about 0 to about 10 degrees.

13. A milling tool to remove material from an underground location as in claim 1 wherein the substantially constant negative radial rake is an angle of about 0 to about 30 degrees.

14. A milling tool to remove material from an underground location as in claim 1 wherein the cutter blades are in a linear form on said cylindrical tool body.

15. A milling tool to remove material from an underground location as in claim 14 wherein said cutter blades have a lead angle of about 0 to about 10 degrees.

16. A milling tool to remove material from an underground location as in claim 14 wherein the negative radial rake of the cutter blade is about 0 to about 30 degrees.

17. A milling tool to remove material from an underground location as in claim 14 wherein the leading surface of each cutter blade has thereon a plurality of cylindrical cutting inserts.

18. A milling tool to remove material from an underground location as in claim 17 wherein said cylindrical inserts have a thickness of at least about 0.125 inch and a diameter of at least about 0.25; inch.

19. A milling tool to remove material from an underground location as in claim 18 wherein said cylindrical cutting inserts have a thickness of about 0.210 inch and a diameter of about 0.375 inch.

20. A milling tool to remove material from an underground location as in claim 1 wherein the cutting inserts are arranged on adjacent cutting blades to be about 0.0625 inch to about 0.25 inch offset from a latitudinal plane through said tool body.

21. A milling tool to remove material from an underground location as in claim 20 wherein the cutting inserts are cylindrical cutting inserts.

22. A milling tool to remove material from an underground location as in claim 21 wherein said cylindrical cutting inserts have a thickness of at least about 0.125 inch and a diameter of at least about 0.25 inch.

23. A milling tool to remove material from an underground location as in claim 22 wherein said cylindrical cutting inserts have a thickness of at least about 0.210 inch and a diameter of at least about 0.375 inch.

24. A milling tool to remove material from an underground location as in claim 20 wherein said cutter blades are in a spiral form on said tool body.

25. A milling tool to remove material from an underground location as in claim 24 wherein said cutting inserts on said cutter blades have a lead angle of about 0 to about 10 degrees.

26. A milling tool to remove material from an underground location as in claim 24 wherein the substantially constant negative radial rake is an angle of about 0 to about 30 degrees.

27. A milling tool to remove material from an underground location as in claim 20 wherein said cutter blades are in a linear form on said tool body.

28. A milling tool to remove material from an underground location as in claim 27 wherein said cutting inserts on said cutter blades have a lead angle of about 0 to about 10 degrees.

29. A milling tool to remove material from an underground location as in claim 1 wherein said cutter blades are fixedly attached to said tool body.

30. A milling tool to remove material from an underground location as in claim 29 wherein said cutter blades are in a spiral form on said cylindrical tool body.

31. A milling tool to remove material from an underground location as in claim 30 wherein the cutting inserts on said cutter blades have a lead angle of about 0 to about 10 degrees.

32. A milling tool to remove material from an underground location as in claim 30 wherein the substantially constant negative radial rake is an angle of about 0 to about 30 degrees.

* * * * *